US006280896B1

(12) United States Patent
Tokutake et al.

(10) Patent No.: US 6,280,896 B1
(45) Date of Patent: Aug. 28, 2001

(54) PHOTOSENSITIVE MEMBER FOR ELECTROPHOTOGRAPHY

(75) Inventors: Shigeaki Tokutake, Takatsuki; Teiko Edo, Kawanishi; Keiichi Inagaki, Itami, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/617,101

(22) Filed: Jul. 14, 2000

(30) Foreign Application Priority Data

Jul. 19, 1999 (JP) ..... 11-204616

(51) Int. Cl.[7] ..... G03G 5/14
(52) U.S. Cl. ..... 430/67; 430/132
(58) Field of Search ..... 430/66, 67, 132

(56) References Cited

U.S. PATENT DOCUMENTS

| | | | | |
|---|---|---|---|---|
| 5,260,157 | | 11/1993 | Mizuta et al. | 430/66 |
| 5,905,008 | * | 5/1999 | Yoshinaga et al. | 430/66 |
| 5,912,098 | | 6/1999 | Tanaka et al. | 430/67 |

FOREIGN PATENT DOCUMENTS

| | | |
|---|---|---|
| 61-51155 | 3/1986 | (JP) . |
| 1-263660 | 10/1989 | (JP) . |
| 3-135577 | 6/1991 | (JP) . |
| 3-141365 | 6/1991 | (JP) . |
| 5-341551 | 12/1993 | (JP) . |
| 8-95280 | 4/1996 | (JP) . |

* cited by examiner

*Primary Examiner*—John Goodrow
(74) *Attorney, Agent, or Firm*—McDermott, Will & Emery

(57) ABSTRACT

The present invention provides a photosensitive member for electrophotography which has an excellent adhesion between a surface protective layer and a photosensitive layer and an excellent image quality at the time of plate wearing.

In the photosensitive member for electrophotography wherein at least the photosensitive layer and the surface protective layer are laminated on an electroconductive support in this order, the characteristic is that said surface protective layer comprises at least fluorine-containing polysiloxane, ultraviolet absorber and electroconductive fine particles.

18 Claims, No Drawings

PHOTOSENSITIVE MEMBER FOR ELECTROPHOTOGRAPHY

This application is based on application No. 204616/1999 filed in Japan, the contents of which are hereby incorporated by reference.

BACKGROUND OF THE INVENTION

1. Field of the Invention

The present invention relates to a photosensitive member for electrophotography, more particularly, relates to the photosensitive member for electrophotography which can be adopted for a copying machine for a digital image.

2. Description of the Related Art

In the photosensitive member which has formerly been employed in the field of the electrophotography, it is a general technical matter to form a surface protective layer on a photosensitive layer formed on an electroconductive support in order to prevent an abrasion of the photosensitive layer caused by a cleaning member and the like as well as an injection of charge into the photosensitive layer. It has been known that silica is a preferred compound for the surface protective layer from the viewpoint of a durability, said silica being constituted by three-dimensional network of siloxane bond (Si—O—Si bond). However, in the case of the surface protective layer consisting of only silica, there are problems that cracks occur on the surface of said layer, and an adhesion to the photosensitive layer becomes worse, and an electrostatic property of the photosensitive layer is lowered [see, for example, Japanese Patent Publication (KOKAI) Nos. 51155/1986].

For this reason, the surface protective layers have been proposed which are prepared by coating a solution comprising a mixture of polymers, such as acrylic resin, urethane elastomer, polyamide or the like and an organosilane which is a raw material of silica (solution for protection the surface) on the photosensitive layer and then curing said mixture [see, for example, Japanese Patent Publication (KOKAI) Nos. 141365/1991, 263660/1989, 341551/1993 and 135577/1991, and U.S. Pat. No. 5,260,157].

However, although the adhesion between the surface protective layer and the photosensitive layer is increased, there are various problems that a sensitivity is worse, an electric potential increases at the time of plate wearing, and harmful influences such as a fog and the like are brought about on the image quality. Although it has been proposed that an electroconductive metallic oxide is added to the surface protective layer in order to suppress the increase of the electric potential, harmful influences such as an image flowing, an image shading and the like are brought about at the time of plate wearing under the hot and humid circumstance.

SUMMARY OF THE INVENTION

The present invention has been carried out in view of the aforementioned situation.

The object of the present invention is to provide a photosensitive member for electrophotography having an excellent adhesion between the surface protective layer and the photosensitive layer and an excellent image quality at the time of plate wearing.

Another object of the present invention is to provide a photosensitive member for electrophotography having excellent electrostatic properties, such as sensitivity, which does not bring about the problems concerning cracks and the like.

The present invention relates to a photosensitive member for electrophotography comprising:

an electroconductive support, a photosensitive layer, and a surface protective layer comprising fluorine-containing polysiloxane, ultraviolet absorber and electroconductive fine particles, and a production method thereof.

DETAILED DESCRIPTION OF THE INVENTION

The fluorine-containing polysiloxane which constitutes the surface protective layer of the photosensitive member for electrophotography according to the present invention is a compound which has a linear, cyclic or network polysiloxane backbone constructed from the repeated siloxane bonds to which fluorine atoms or fluorine atom-containing groups are bonded. Preferably, the fluorine-containing polysiloxane has the network polysiloxane backbone to which fluorine atoms or fluorine atom-containing groups are bonded. More preferably, the fluorine-containing polysiloxane has the network polysiloxane backbone to which fluorine atoms or fluorine atom-containing groups are uniformly bonded. The uniformly bonded state is a state wherein fluorine atoms or fluorine atom-containing groups are not localized in a certain part of the polysiloxane layer, but widely, uniformly distributed over the whole of the polysiloxane layer.

The fluorine-containing polysiloxane may be prepared by any publicly known method using the publicly known compounds as a material provided that a polysiloxane can be obtained which has fluorine atoms or fluorine atom-containing groups. For example, the fluorine-containing polysiloxane can be prepared by reacting an organosilane with a fluorine-containing silane coupling agent or by introducing fluorine atoms or fluorine atom-containing groups into a polysiloxane. In the present invention, preferred fluorine-containing polysiloxane can be prepared by reacting an organosilane with a fluorine-containing silane coupling agent. The fluorine-containing polysiloxane will be illustrated hereinafter which can be prepared by reacting an organosilane with a fluorine-containing coupling agent.

As an organosilane for preparing the fluorine-containing polysiloxane, any oraganosilane may be employed provided that it can provide the network polysiloxane having a structure wherein a siloxane bond is three-dimensionally repeated. For example, the organosilane represented by the following general formula (I) can be mentioned:

$$(R^1)_n Si(OR^2)_{4-n} \quad (I)$$

wherein $R^1$ is an organic group having $C_1$–$C_8$, $R^2$ is hydrogen atom, alkyl group having $C_1$–$C_5$ or acyl group having $C_1$–$C_4$, and n is an integer of 0–3.

As the organic group having $C_1$–$C_8$ of $R^1$ in the general formula (I), the following groups are exemplified: alkyl group, such as methyl group, ethyl group, n-propyl group, i-propyl group, n-butyl group, i-butyl group, sec-butyl group, t-butyl group, n-pentyl group, n-hexyl group, n-heptyl group, n-octyl group and the like, γ-chloropropyl group, vinyl group, 3,3,3-trifluoropropyl group, γ-glycidoxypropyl group, phenyl group, γ-methacryloxypropyl group, γ-mercaptopropyl group, 3,4-epoxycyclohexylethyl group and the like.

As the alkyl group having $C_1$–$C_5$ of $R^2$, methyl group, ethyl group, n-propyl group, i-propyl group, n-butyl group, i-butyl group, sec-butyl group, t-butyl group, n-pentyl group and the like are exemplified. As the acyl group having $C_1$–$C_4$ of $R^2$, acetyl group and the like are exemplified.

In the case where plural $OR^2$ groups are present in the aforesaid formula, it doesn't always follow that all the $OR^2$ groups must be same, i.e., all the $OR^2$ groups can independently be selected within the aforementioned range. In the case where plural $R^1$ groups are present, all the $R^1$ groups can independently be selected within the aforementioned range as in the case where plural $OR^2$ groups are present. When the compounds represented by the aforesaid formula where n=2 or 3 are employed, it is preferable to use jointly with the compounds of the aforesaid formula where n=0 or 1 because a three-dimensionalization of the siloxane bonds become easier.

As the concrete examples of the organosilanes, the following compounds are exemplified: tetramethoxysilane, tetraethoxysilane, methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, dimethyldimethoxysilane, dimethyldiethoxysilane, diethyldimethoxysilane, diethyldiethoxysilane, di-n-propyldimethoxysilane, di-n-propyldiethoxysilane, di-i-propyldimethoxysilane, di-i-propyldiethoxysilane, γ-chloropropyltrimethoxysilane, γ-chloropropyltriethoxysilane, vinyltrimethoxysilane, vinyltriethoxysilane, 3,3,3-trifluoropropylmethoxysilane, 3,3,3-trifluoro-propyltriethoxysilane, γ-glycidoxypropyltrimethoxysilane, γ-glycidoxypropyltriethoxysilane, γ-methacryloxypropyltrimethoxysilane, γ-methacryloxypropyltriethoxysilane, γ-mercaptopropyltrimethoxysilane, γ-mercaptopropyltriethoxysilane, phenyltrimethoxysilane, phenyltriethoxysilane, 3,4-epoxycyclohexylethyltrimethoxysilane, 3,4-epoxycyclohexylethyltriethoxysilane, γ-aminopropylmethoxysilane, γ-aminopropylethoxysilane and the like. The preferred organosilanes are methyltrimethoxysilane and methyltriethoxysilane. The organosilane (I) may be used independently or may be used as a mixture of two or more of the organosilanes.

For example, the following commercially available products can be employed as methylmethoxysilane: TSL8113 (Toshiba Silicone Co.), D031A (Chisso Co.), Solguard NP-720 (Nippon Dacroshamrock Co.), Tossguard 510 (Toshiba Silicone Co.), KP-64 (Shinetsu Kagaku Kogyo Co.) and the like.

Oligomers such as diner, trimer and the like may be employed in the present invention in place of or together with the organosilane, said oligomers being prepared by partial condensation of the above exemplified organosilanes. Preferably, the oligomers have two or more (preferably three or more) of alkoxy groups or hydroxyl groups.

Fluroine-containing silane coupling agents employed in the present invention can be represented by the following general formula (II):

$$CF_3(CF_2)_m(CH_2)_pSi(OR^3)_q \underset{R^4_{3-q}}{|} \quad \text{(II)}$$

wherein $R^3$ or $R^4$ is independently hydrogen atom or an alkyl group having $C_1$–$C_3$, m is integer of 1–7, p is 1 or 2, and q is 2 or 3. In the case where plural $OR^3$ groups are present in the above formula (II), it doesn't always follow that all the $OR^3$ groups must be same, i.e., all the $OR^3$ groups can independently be selected within the aforesaid range.

The following compounds can be exemplified as the concrete examples of fluorine-containing coupling agents: $CF_3(CF_2)_7CH_2CH_2Si(OCH_3)_3$, $CF_3(CF_2)_7CH_2CH_2Si(OCH_3)_2CH_3$, $CF_3(CF_2)_7CH_2Si(OCH_3)_3$, $CF_3(CF_2)_6CH_2CH_2Si(OCH_3)_3$, $CF_3(CF_2)_6CH_2CH_2Si(OCH_3)_2CH_3$, $CF_3(CF_2)_6CH_2Si(OCH_3)_3$, $CF_3(CF_2)_7CH_2CH_2Si(OC_2H_5)_3$, $CF_3(CF_2)_7CH_2CH_2Si(OC_3H_7)_3$ and the like.

Among others it is preferable to use $CF_3(CF_2)_7CH_2CH_2Si(OCH_3)_3$, $CF_3(CF_2)_7CH_2CH_2Si(OC_3H_7)_3$ or $CF_3(CF_2)_7CH_2CH_2Si(OC_2H_5)_3$.

Fluorine-containing coupling agent (II) may be used independently or may be used as a mixture of two or more of said coupling agent.

The commercially available products such as KBM-7803 (Shinetsu Kagaku Kogyo Co.) can be used as the compound of $CF_3(CF_2)_7CH_2CH_2Si(OCH_3)_3$. Furthermore, the commercially available products such as XC95-A9715 (Toshiba Silicone Co.) can be used as the compound of $CF_3(CF_2)_7CH_2CH_2Si(OC_3H_7)_3$.

From the viewpoints of a sensitivity decrease of a photosensitive member and an increase of a residual potential at the time of plate wearing, a desirable amount of fluorine-containing silane coupling agent to be used is 1–20 parts by weight, preferably 3–12 parts by weight in relation to 100 parts by weight of the organosilane.

The surface protective layer according to the present invention contains an ultraviolet absorber. By adding the ultraviolet absorber into the surface protective layer, an adhesion becomes better, and occurrence of cracks can be inhibited.

Any of the ultraviolet absorbers can be used which are publicly known in the field of photosensitive member. Among others it is preferable to use the ultraviolet absorbers having hydroxyl group which are soluble in an alcohol used for forming the surface protective layer. The ultraviolet absorbers of this type such as benzophenone compounds, benzotriazole compounds, benzoate compounds, salicylate compounds and the like may be used.

As the concrete examples of benzophenone compounds, the following compounds can be cited: 2,4-dihydroxybenzophenone (for example, the commercially available product: Viosorb 100), 2,2',4,4'-tetrahydroxybenzophenone (for example, the commercially available product: Viosorb 105), 2-hydroxy-4-methoxybenzophenone (for example, the commercially available product: Viosorb 110), 2-hydroxy-4-methoxybenzophenone-5-sulfonic acid (for example, the commercially available product: Viosorb 111), 2-hydroxy-4-n-octoxybenzophenone (for example, the commercially available product: Viosorb 130) and the like.

As the concrete examples of benzotriazole compounds, the following compounds can be mentioned: 2-(2'-hydroxy-4'-n-octoxyphenyl) benzotriazole (for example, the commercially available product: Viosorb 510), 2-(2'-hydroxy-5'-methylphenyl) benzotriazole (for example, the commercially available product: Viosorb 520), 2-(2'-hydroxy-3'-tert-butyl-5'-methylphenyl)-5-chlorobenzotriazole (for example, the commercially available product: Viosorb 550), 2-(2'-hydroxy-3',5'-di-tert-butylphenyl)-5-chlorobenzotriazole (for example, the commercially available product: Viosorb 580), 2-(2'-hydroxy-3',5'-di-tert-butylphenyl) benzotriazole (for example, the commercially available product: Viosorb 582), 2-(2'-hydroxy-5'-tert-octylphenyl) benzotriazole (for example, the commercially available product: Viosorb 583), 2-[2'-hydroxy-3'-(3",4",5",6"-tetrahydrophthalimidemethyl)-5'-methylphenyl] benzotriazole (for example, the commercially available product: Viosorb 590), 2-(2'-hydroxy-3',5'-di-tert-amylphenyl) benzotriazole (for example, the commercially available product: Viosorb 591) and the like.

As the concrete examples of benzoate compounds, 2,4-di-tert-butylphenyl-3,5-di-tert-butyl-4-hydroxybenzoate (for example, the commercially available product: Viosorb 80) and the like can be cited.

As the concrete examples of salicylate compounds, p-tert-butylphenylsalicylate (for example, the commercially available product: Viosorb 90) and the like can be mentioned.

Among others it is preferable in the present invention to use 2,4-dihydroxybenzophenone, 2,2',4,4'-tetrahydroxybenzophenone, 2-hydroxy-4-methoxybenzophenone or 2-(2'-hydroxy-5'-methylphenyl) benzotriazole.

From the viewpoints of an adhesion to the photosensitive layer, an occurrence of cracks, a sensitivity decrease, and an increase of residual potential at the time of plate wearing, a desirable amount of the ultraviolet absorber to be used is 0.1–20 parts by weight, preferably 0.1–10 parts by weight in relation to 100 parts by weight of the organosilane. The ultraviolet absorbers may be used independently or jointly. In the case where they are employed jointly, their total amount of use may be fallen within the above range.

In addition, electroconductive fine particles are dispersed in the surface protective layer according to the present invention. By dispersing the electroconductive fine particles in the surface protective layer, an electric resistance of the surface protective layer itself can be controlled, and an increase of residual potential in the photosensitive member during the repeating processes of electrophotography can be prevented.

The electroconductive fine particles are not restricted in particular provided that said fine particles consist of an electroconductive material. Fine particles of metallic oxides such as tin oxide, zinc oxide, titanium oxide, indium oxide, antimony oxide, bismuth oxide, tin oxide containing antimony as a dopant, indium oxide containing tin as a dopant and the like may be employed. The electroconductive fine particles may be used as a mixture consisting of two or more kinds of electroconductive fine particles. From the viewpoint of transmittance of the surface protective layer, preferable mean primary particle size of the electroconductive fine particles is 0.01–1.0 $\mu$m, more preferably 0.01–0.3 $\mu$m.

From the viewpoint of an environmental resistance, it is preferable to subject the aforesaid electroconductive fine particles to a surface treatment with the treating agent represented by the following general formula (III):

(III)

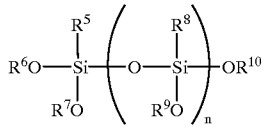

wherein each of $R^5$, $R^6$, $R^7$, $R^8$, $R^9$ and $R^{10}$ is independently methyl group or ethyl group, n is an integer of 1 or more, preferably 2–50, more preferably 3–10. As regards this surface treatment, it is more preferable to employ the treating agent of the formula (III) wherein $R^5$, $R^6$, $R^7$, $R^8$, $R^9$ and $R^{10}$ are simultaneously methyl groups or ethyl groups. The desirable weight-average molecular weight of the above treating agent is 300–5000, preferably 300–1000. By subjecting the electroconductive fine particles to the surface treatment with the aforesaid treating agent, a control of an electrical resistance of the protective layer becomes easier when a process of an electrophotography is repeatedly carried out under the all-circumstances.

The surface treatment may be carried out by a process which comprises (i) diluting the treating agent with a suitable solvent to prepare a solution of said treating agent whose concentration is about 0.1–10%, (ii) adding the electroconductive fine particles into said solution or spraying said solution on the electroconductive fine particles, (iii) agitating the mixture sufficiently, (iv) aging the mixture under an atmosphere of air, and then (v) drying the mixture by evaporating the solvent therefrom. When a rapid heating is employed at the time of evaporating the solvent, the formed film becomes fragile because cracks are apt to form in said film. A catalyst which accelerates the reaction may be added to the treating solution.

From the viewpoints of a sensitivity decrease of the photosensitive member, an increase of the residual potential at the time of plate wearing and an image flowing under the hot and humid circumstance, a desirable amount of the electroconductive fine particles is 0.1–60 parts by weight, preferably 1–30 parts by weight in relation to 100 parts by weight of the organosilane. The electroconductive fine particles may be used independently or jointly. In the case where they are employed jointly, their total amount of use may be fallen within the above range.

In order to prepare the surface protective layer comprising aforementioned materials, any method may be employed provided that the surface protective layer can be obtained wherein the ultraviolet absorber and the electroconductive fine particles are included in the fluorine-containing polysiloxane. The surface protective layer according to the present invention may preferably be prepared by a method which comprises (i) the organosilane and the fluorine-containing silane coupling agent are previously reacted to obtain a product, (ii) adding at least the ultraviolet absorber and the electroconductive fine particles to the product, (iii) agitating the mixture to obtain a surface protecting solution, (iv) applying the surface protecting solution on the photosensitive layer and the (v) curing the applied layer.

The aforementioned method is detailedly described hereinafter. Firstly the aforesaid organosilane and fluorine-containing silane coupling agent are reacted. A reaction ratio by weight of the both reaction components may be adjusted in such a way that an amount of the fluorine-containing silane coupling agent to that of the organosilane are fallen within the aforesaid range.

From the viewpoint of accelerating the hydrolyzing reaction, it is preferable to add an acid to the reaction system as a catalyst. Acids, such as acetic acid, hydrochloric acid, formic acid, propionic acid, benzoic acid and the like may be employed as the catalyst. An amount of the catalyst to be used is 0.01–6 parts by weight, preferably 0.03–4 parts by weight in relation to 100 parts by weight of the organosilane.

An existence of water in the reaction system is preferable from the viewpoint of accelerating the hydrolysis. A suitable amount of water to be used is 10–50 parts by weight, preferably 20–40 parts by weight in relation to 100 parts by weight of the organosilane used.

In addition, the aftermentioned curing accelerators may be added to the reaction system. An amount of the curing accelerators to be added is 0.05–20 parts by weight, preferably 0.1–10 parts by weight in relation to 100 parts by weight of the organosilane.

A reaction condition depends on the reacivities of the oraganosilane and fluorine-containing silane coupling agent to be used, and is not restricted in particular if a polymerization degree of a product is so suitable that said product has not siloxane bonds which repeat three-dimensionally and that a viscosity of the aftermentioned surface protective solution which contains said product is adjustable. For example, in the case where methyltrimethoxysilane and $CF_3(CF_2)_7CH_2CH_2Si(OCH_3)_3$ are employed as the organosilane and fluorine-containing silane coupling agent respectively, it is desirable to carry out the reaction at 0–20° C., preferably 0–10° C. for not less than 10 hours, preferably 12–20 hours.

Then at least the ultraviolet absorber and electroconductive fine particles are added to the reaction product of the organosilane and fluorine-containing silane coupling agent, and the mixture is agitated to obtain the surface protective solution. The surface protective solution is applied on the photosensitive layer, and the applied film is cured. At the time of preparing the surface protective solution, it is preferable to add the curing accelerator to said solution. An addition of the curing accelerator accelerates the hydrolysis and/or condensation reaction of the organosilane and fluorine-containing silane coupling agent, and surely brings about a three-dimensionalization of the siloxane bonds.

The following compounds are exemplified as the curing accelerator: alkali metal salts of naphthenic acid, octylic acid, nitrous acid, sulfurous acid, aluminic acid, carbonic acid and the like; alkaline compounds, such as sodium hydroxide, potassium hydroxide and the like; acidic compounds, such as alkyltitanic acid, phosphoric acid, p-toluenesulfonic acid, phthalic acid and the like; aminic compounds, such as ethylenediamine, hexanediamine, diethylenetriamine, triethylenetetramine, tetraethylenepentamine, piperidine, piperazine, methaphenylenediamine, ethanolamine, triethylamine, various modified amines which are used as a curing agent for epoxy resin, γ-aminopropyltriethoxysilane, γ-(z-aminoethyl)-aminopropyltrimethoxysilane, γ-(z-aminoethyl)-aminopropylmethyldimethoxysilane, γ-anilinopropyltrimethoxysilane and the like; organic tin compounds of carboxylic acid type, such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHCOOC_4H_9)_2$, $(C_8H_{17})_2Sn(OCOC_{11}H_{23})_2$, $(C_8H_{17})_2Sn(OCOCH{=}CHCOOCH_3)_2$, $(CH_8H_{17})_2Sn(OCOCH{=}CHCOOC_4H_9)_2$, $(C_8H_{17})_2Sn(OCOCH{=}CHCOOC_8H_{17})_2$, $Sn(OCOCC_8H_{17})_2$ and the like; organic tin compounds of mercaptide type, such as $(C_4H_9)_2Sn(SCH_2COO)_2$, $(C_4H_9)_2Sn(SCH_2COOC_8H_{17})_2$, $(C_8H_{17})_2Sn(SCH_2COO)_2$, $(C_8H_{17})_2Sn(SCH_2CH_2COO)_2$, $(C_8H_{17})_2Sn(SCH_2COOCH_2CH_2OCOCH_2S)_2$, $(C_8H_{17})_2Sn(SCH_2COOCH_2CH_2CH_2CH_2OCOCH_2S)_2$, $(C_8H_{17})_2Sn(SCH_2COOC_8H_{17})_2$, $(C_8H_{17})_2Sn(SCH_2COOC_{12}H_{25})_2$,

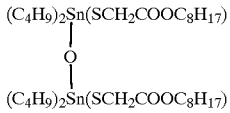

and the like; organic tin compounds of sulfide type, such as

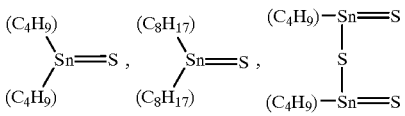

and the like; the reaction products of organic tin oxides, such as $(C_4H_9)_2SnO$, $(C_8H_{17})_2SnO$, $(C_4H_9)_2SnO$, $(C_8H_{17})_2SnO$ and the like and esters, such as ethyl silicate, ethyl silicate 40, dimethyl maleate, diethyl maleate, dioctylphthalate and the like; the aftermentioned metallic chelate compounds and the like.

These curing accelerators may be used independently or may be used as a mixture of two or more of said compounds. In the present invention, it is preferable to employ the compounds exemplified as an amine compound from a viewpoint of an adhesiveness to the underlying photosensitive layer.

The metallic chelate compound is the chelate compound of the metal selected from the group consisting of zirconium, titanium and aluminum hereinafter referred to as metallic chelate compound (IV).

As the metallic chelate compound (IV), the compounds represented by the following general formulae, the partially hydrolyzed products of these compounds and the like are exemplified:

$Zr(OR^{11})_a(R^{12}COCHCOR^{13})_{4-a}$ $Ti(OR^{11})_b(R^{12}COCHCOR^{13})_{4-b}$ or $Al(OR^{11})_c(R^{12}COCHCOR^{13})_{3-c}$

In the metallic chelate compound (IV), $R^{11}$ and $R^{12}$ indicate indepedently monovalent hydrocarbon radical having $C_1$–$C_6$, such as ethyl group, n-propyl group, i-propyl group, n-butyl group, sec-butyl group, t-butyl group, n-pentyl group, n-hexyl group, cyclohexyl group, phenyl group and the like, $R^{13}$ indicates the same monovalent hydrocarbon radical having $C_1$–$C_6$ as those indicated by $R^{11}$ and $R^{12}$ as well as alkoxy group, such as methoxy group, ethoxy group, n-propoxy group, n-butoxy group, sec-butoxy group, t-butoxy group, lauryloxy group, stearyloxy group and the like, a and b is an integer of 0–3, and c is an integer of 0–2.

As the concrete examples of these metallic chelate compounds (IV), the following compounds are mentioned: zirconium chelate compounds, such as tri-n-butoxy ethylacetoacetate zirconium, di-n-butoxy bis(ethylacetoacetate) zirconium, n-butoxy tris(ethylacetoacetate)zirconium, tetrakis(n-propylacetoacetate)zirconium, tetrakis (acetylacetoacetate)zirconium, tetrakis(ethylacetoacetate) zirconium and the like; titanium chelate compounds, such as di-i-propoxy bis(ethylacetoacetate)titanium, di-i-propoxy bis(acetylacetate)titanium, di-i-propoxy bis(acetylacetone) titanium and the like; aluminum chelate compounds, such as di-i-propoxy ethylacetoacetate aluminum, di-i-propoxy acetylacetonate aluminum, i-propoxy bis(ethylacetoacetate) aluminum, i-propoxy bis(acetylacetonate)aluminum, tris (ethylacetoacetate)aluminum, tris(ethylacetate)aluminum, tris(acetylacetonate)aluminum, monoacetylacetonate bis (ethylacetoacetate)aluminum and the like. Among these compounds, tri-n-butoxy ethylacetoacetate zirconium, di-i-propoxy bis(acetylacetonate)titanium, di-i-propoxy ethylacetoacetate aluminum and tris(ethylacetoacetate)aluminum are preferred. These metallic chelate compounds (IV) may be used independently or may be used as a mixture of two or more of said compounds.

From the viewpoints of a film strength and a pot life of a coating solution, suitable amount of the curing accelerator added to the surface protective solution (said amount is a total amount when two or more of the curing accelerators are used) is 0.1–50 parts by weight, preferably 0.1–10 parts by weight in relation to 100 parts by weight of the organosilane used in the aforementioned reaction.

The aforementioned ultraviolet absorber and electroconductive fine particles are added to the surface protective solution. These additives are added to said solution in such a way that an amount of each additive in the surface protective layer is fallen within the aforesaid range.

In the case where other desirable additives will be included in the surface protective layer, they may be added to the surface protective solution. As the desirable additives which can be added to the surface protective solution, a surfactant, a silane coupling agent, a titanium coupling agent and the like are exemplified. As an example of a surfactant, sodium acetate, modified polysiloxane (e.g. BYK 300: Bickchemie Co.) and the like can be mentioned.

A viscosity of the surface protective solution may be adjusted in such a way that a film thickness of the surface protective layer to be formed can be controlled within the aftermentioned range and said layer can uniformly be formed.

At the time when the surface protective solution is prepared, an organic solvent may be used in the present invention in order to adjust the concentration of the total solid components and the viscosity of said solution. As an organic solvent, it is preferable to use the organic solvents, such as alcohols, aromatic hydrocarbons, ethers, ketones, esters and the like. As the alcohols, for example, monovalent or divalent alcohols can be mentioned. Concretely, the following alcohols are exemplified: methanol, ethanol, n-propyl alcohol, isopropyl alcohol, n-butyl alcohol, sec-butyl alcohol, t-butyl alcohol, n-hexyl alcohol, n-octyl alcohol, ethylene glycol, diethylene glycol, triethylene glycol, ethylene glycol monomethyl ether, ethylene glycol monoethyl ether, ethylene glycol mono n-propyl ether, ethylene glycol mono n-butyl ether, ethylene glycol monomethyl ether acetate, ethylene glycol monoethyl ether acetate and the like. Among these alcohols, monovalent saturated aliphatic alcohols having $C_1$–$C_8$ are preferred. Benzene, toluene, xylene and the like can be exemplified as the aforesaid aromatic hydrocarbons. Tetrahydrofuran, dioxane and the like can be mentioned as the aforesaid ethers. Ethyl acetate, n-propyl acetate, n-butyl acetate, propylene carbonate and the like can be mentioned as the aforesaid esters. These organic solvents may be used independently or may be used as a mixture of two or more of said organic solvents. The method of adding the organic solvents is not restricted in particular. The organic solvents may be added at the time of preparing the surface protective solution and/or at a suitable stage after said solution is prepared.

In order to prevent a damage of the underlain photosensitive layer by the organic solvent (b) used, it is desirable to use alcoholic solvents and other solvents in a weight ratio of 80/20–100/0, preferably 90/10–100/0.

The method of coating the surface protective solution on the photosensitive layer is not restricted in particular insofar as the layer thickness of the formed surface protective layer can be controlled within the aforesaid range and the surface protective layer can uniformly be formed. The publicly known methods, such as brushing method, spray coating method, immersion method, roll coating method, flow-coating method, vacuum coating method, air-knife coating method, doctor blade coating and the like may be adopted. These coating methods can be carried out by batch mode, semicontinuous mode or continuous mode.

After the surface protective solution is coated on the photosensitive layer, the curing treatment, i.e., the three-dimensionalization of siloxane bonds, is carried out. More concretely, the photosensitive layer on which said solution is coated is left at rest at 60–125° C., preferably 80–120° C. for 10–60 minutes, preferably 20–40 minutes. When the temperature exceeds 125° C., the electrostatic properties, such as the sensitivity and the like of the photosensitive layer are deteriorated. On the other hand, when the temperature is less than 60° C., and imperfect three-dimensionalization of siloxane bonds is apt to occur, and the layer becomes fragile.

From the viewpoints of a decrease of a sensitivity and a residual potential increase at the time of plate wearing, it is preferable to adjust the film thickness of the surface protective layer to 0.03–5 μm, preferably 0.1–3 μm.

In the present invention, the photosensitive layer on which the aforementioned surface protective layer can be formed may have any of the morphologies wherein (i) a charge generating layer and a charge transporting layer are laminated on the electroconductive support in this order, (ii) the charge transporting layer and the charge generating layer are laminated on the electroconductive support in this order, and (iii) a monolayer comprising a charge transporting material and a charge generating material is laminated on the electroconductive support. The photosensitive layer having the morphology wherein the charge generating layer and the charge transporting layer are laminated on the electroconductive support in this order will be illustrated hereinafter.

A foil or plate having the shape of drum made of cupper, aluminum, iron, nickel or the like is used as the electroconductive support. The electroconductive support which can be used may be prepared by forming the metal layer on the plastics layer and the like by vacuum spraying, spattering or electroless plating of these metals, or by forming the conductive layer on the paper or plastics layer by coating, vapor deposition or spattering of conductive compounds, such as a conductive polymer, indium oxide, tin oxide and the like. In general, cylindrical aluminum supports is used. More concretely, the following cylindrical supports are exemplified: ED pipe prepared by subjecting the aluminum material to extrusion molding and then to cold drawing molding; cutting pipe prepared by subjecting the aluminum material to extrusion molding and then to drawing molding to form an aluminum pipe, which is cut into parts whose outer surfaces are subjected to the finishing cut (about 0.2–0.3 mm) by means of cutting tools, such as diamond bite; EI pipe prepared by subjecting the aluminum disc to impact work to make the cup whose outer surface is subjected to the finishing wipe work; DI pipe prepared by subjecting the aluminum disc to deep drawing work to made the pipe whose outer surface is subjected to the finishing wipe work. These pipes may be used after they are subjected to the additional surface treatments by cutting or anodizing.

Although the charge generating layer and the charge transporting layer are laminated on these electroconductive support in this order, it is preferable to form the undercoat on the electroconductive support previously in order to prevent the charge injection from said support.

In the embodiment wherein the undercoat layer is formed on the electroconductive support, the suitable undercoat layer may be prepared by using the polymers themselves, such as polyimide, polyamide, nitrocellulose, polyvinyl butyral, polyvinyl alcohol, polyacrylate and the like, or the polymer compositions comprising any of the polymers as well as low resistant compounds, such as tin oxide, indium oxide and the like, or the deposited layers of aluminum oxide, zinc oxide, silicon oxide and the like. It is desirable to adjust the layer thickness of the undercoat to 1 μm and less.

The charge generating layer may be formed by (i) depositing the charge generating material under vacuum, (ii) coating the solution prepared by dissolving the charge generating materials in the solvents, such as amines and the like and then drying the coated solution, or (iii) coating the dispersion prepared by dispersing a pigment in a suitable solvent or the solution comprising a binder resin if necessary and then drying the coated dispersion.

As the charge generating materials which may be used for the photosensitive member according to the present invention, the following organic materials are exemplified: bisazo pigments, triarylmethane dyes, thiazine dyes, oxazine dyes, xanthene dyes, cyanine dyes, styryl dyes, pyrylium dyes, azo dyes, quinacridone dyes, indigo pigments, perylene pigments, polycyclic pigments, bisbenzimidazole pigments, indanthrone pigments, squalerium pigments, phthalocyanine pigments and the like. In addition, any other materials may be used insofar as they generate the charge carriers in extremely high efficiency when they absorb light.

The charge transporting layer is formed by coating the coating solution prepared by dispersing the charge transfering material in the solution containing the binder resin, and then drying the coated solution.

As the charge transporting material used for the photosensitive member according to the present invention, the following materials are exemplified: hydrazone compounds, phrazoline compounds, styryl compounds, triphenyl methane compounds, oxadiazole compounds, carbozole compounds, stilbene compounds, enamine compounds, oxazole compounds, triphenylamine compounds, tetraphenyl benzidine compounds, azoine compounds and the like.

The binder resins used for the preparation of the photosensitive member according to the present invention are the insulating resins. It is desirable that the insulating resins have a volume resistivity of $1\times10^{12}\Omega\cdot$cm and more which is measured independently. For example, the publicly known thermoplastic resins, thermosetting resins, photosetting resins, photoconductive resins and the like may be used as the binder resins. The following resins are mentioned as the concrete examples of the binder resins: the thermoplastic resins, such as polyester resin, polyamide resin, acryl resin, ethylene-vinyl acetate resin, ionic crosslinked olefin copolymer (ionomer), styrene-butadiene block copolymer, polycarbonate, vinyl chloride-vinyl acetate copolymer, cellulose ester, polyimide, styrol resin and the like; the thermosetting resins, such as epoxy resin, urethane resin, silicone resin, phenol resin, melamine resin, xylene resin, alkyd resin, thermosetting acryl resin, and the like; photosetting resin; photoconductive resins, such as polyvinyl carbazole, polyvinyl pyrene, polyvinyl anthracene, polyvinyl pyrrole and the like. These binder resins may be used independently or may be used as a mixture of two or more of these resins.

In the case that the charge transporting materials themselves can used as the binder, it is unnecessary to use another binder resins.

Together with the binder resins, plasticizers, such as halogenated paraffine, polybiphenye chloride, dimethyl naphthalene, dibutyl phthalate, o-terphenyl and the like, electron-attracting sensitizer, such as chloranil, tetracyanoethlene, 2,4,7-trinitrofluorenone, 5,6-dicyanobenzoquinone, tetracyanoquinodimethane, tetrachloro phthalic anhydride, 3,5-dinitrobenzoic acid and the like, and sensitizers, such as methyl violet, rhodamine B, cyanine dye, pyrilium salt, thiapyririum salt and the like may be added to the photosensitive layer of the photosensitive member according to the present invention.

Coating of the photosensitive layer can be carried out by means of publicly known various coating equipments, such as applicator, spray coater, bar coater, dip coater, roll coater, doctor blade and the like.

The aforementioned photosensitive member for electrophotography has excellent adhesiveness between the surface protective layer and the photosensitive layer, durability and electrostatic properties, such as sensitivity and the like, and does not bring about the problems concerning cracks and the like.

Although the present invention will be illustrated in detail by the following examples, the present invention is not restricted by these examples. In the following examples, "part" means "part by weight" unless otherwise indicated.

EXAMPLES

Synthesis of a Silicone Hard Coat Solution A

Methyl trimethoxysilane (50 parts; TSL8113: Toshiba Silicone Co.) and fluorine-containing silane coupling agent represented by the formula of $CF_3(CF_2)_7CH_2CH_2Si(OCH_3)_3$ (5 parts; KBM-7803: Shinetsu Kagaku Kogyo Co.) were added to the solution prepared by dissolving acetic acid (2 parts) in distilled water (20 parts), and the reaction was carried out for 16 hours under agitation while a temperature of the solution was maintained at 0–10° C. Then the temperature of the reaction solution was increased to 20° C., and n-propanol (15 parts) and sodium acetate (0.05 parts) were mixed with the reaction solution to prepare the hard coat solution A.

Preparation of Electroconductive Fine Particles A

The mixture of methanol (100 parts) and silicone agent (2 parts; XC96-B0446: Toshiba Silicone Co.) was sprayed upon stannic oxide fine particles to which antimony fine particles were doped (mean particle size: 0.02 $\mu$m)(100 parts; T-1: Mitsubishi Material Co.) under agitation with a mixer, and the both were mixed. Then the mixture obtained was aged for 12 hours under an atmosphere of air, and subjected to a heat treatment at 130° C. for 2 hours to obtain the electroconductive fine particles A.

Example 1

Surface of the cylindrical aluminum alloy (JIS 5657) (outer diameter: 100 mm, length: 350 mm, thickness: 2 mm) was subjected to a cutting work by means of a bite equipped with natural diamond as a cutting blade. The cylindrical aluminum alloy was subjected to a degreasing treatment at 60±5° C. for 5 minutes using the surfactant "Top Alclean 161" (supplied by Okuno Pharmaceutical industrial Company) as a degreasing agent, and then washed with running water. The cylindrical aluminum alloy was subjected to an etching treatment wherein said alloy was immersed in the solution of nitric acid of 100 g/l for 5 minutes, and then washed with running water. Subsequently, the cylindrical aluminum alloy was subjected to an anodizing treatment (electrolytic solution: the solution of sulfuric acid of 150 g/l, current density: 1 A/dm$^2$, the temperature of the solution: 20° C.) for 15 minutes to form the anodized layer having a thickness of 8 $\mu$m, and washed with running pure water, and then subjected to a sealing treatment at 90° C. for 30 minutes using the aqueous solution of the sealing agent comprising nickel acetate (Sealing salt AS supplied by Clariant Japan Company) of 8 g/l. The photosensitive layer was formed on the substrate having the anodized layer which was subjected to the above sealing treatment according to the following procedure.

X-type phthalocyanine (8120B supplied by Dainihon Ink Kogyo Company)(4.5 parts), butyral resin (S-Lec BH-3 supplied by Sekisui Kagaku Company)(2.5 parts) and phenoxy resin (PKHH supplied by Union Carbide Company) (2.5 parts) were dispersed in dichloroethane (500 parts) by means of sand mill. The charge generating layer was formed by applying the obtained dispersion onto the above substrate in such a way that the layer thickness after dried becomes 0.3 μm.

Styryl compound represented the following formula (40 parts), polycarbonate resin (TS-2050 supplied by Teijin Kasei Company)(60 parts) and phenolic butyl hydroxytoluene (special grade reagent supplied by Tokyo Kasei Company)(2 parts) were dissolved in tetrahydrofuran (400 parts) to prepare the coating solution. The coating solution was applied onto the aforesaid charge generating layer, and then drying the applied solution to form the charge transporting layer having a thickness of 20 μm.

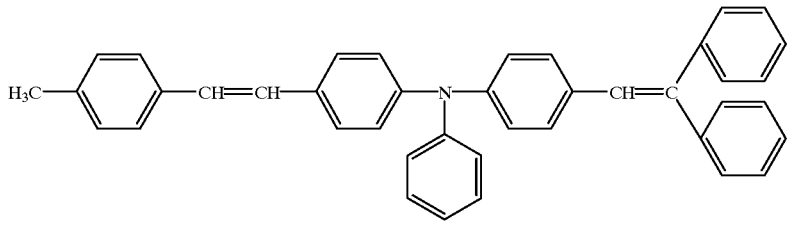

The surface protective solution was prepared by adding the ultraviolet absorber (Viosorb 110 supplied by Kyodo Yakuhin Company)(3 parts) and the electroconductive fine particles A (15 parts) to the silicone hard coat solution A (100 parts) and mixing the admixture by means of a sand mill for 48 hours.

The photosensitive member for electrophotography was prepared by applying the obtained surface protective solution on the aforesaid charge transporting layer in such a way that a layer thickness was 2 μm after drying, and then the applied solution was dried at 100° C. for 30 minutes to give the surface protective layer.

Example 2

The photosensitive member for electrophotography was prepared by the same manner as described in Example 1 except for forming the surface protective layer as described below. Viosorb 105 (Kyodo Yakuhin Co.) was employed as an ultraviolet absorber. The obtained surface protective solution was applied on the aforesaid charge transporting layer in such a way that a layer thickness was 2 μm after drying, and then the applied solution was dried at 120° C. for 10 minutes to form the surface protective layer.

Example 3

The photosensitive member for electrophotography was prepared by the same manner as described in Example 1 except for forming the surface protective layer as described below. Viosorb 520 (Kyodo Yakuhin Co.) was employed as an ultraviolet absorber. The obtained surface protective solution was applied on the aforesaid charge transporting layer in such a way that a layer thickness was 2 μm after drying, and then the applied solution was dried at 120° C. for 10 minutes to form the surface protective layer.

Comparative Example 1

The photosensitive member for electrophotography was prepared by the same manner as described in Example 1 except for omitting the ultraviolet absorber and the electroconductive fine particles.

Comparative Example 2

The photosensitive member for electrophotography was prepared by the same manner as described in Example 1 except for omitting the ultraviolet absorber.

Comparative Example 3

The photosensitive member for electrophotography was prepared by the same manner as described in Comparative example 1 except for using the surface protective solution which was prepared by dispersing Acrylic polyol urethane PG (Kansai Paint Co.) (20 parts) and polyamide resin CM 8000 (Toray Co.) (2 parts) in the medium.

Evaluation

Electrostatic Properties

The obtained photosensitive members were installed into the commercially available electrophotographic copying machine (Di620 manufactured by Minolta Co., Ltd.) and charged with electricity (−6 KV), and then an initial surface electric potential [VO(V)], a ratio of an exposure dose required to make the initial surface electric potential half-value to a sensitivity [E1/2 ($\mu J/cm^2$)] and an image electric potential [Vi (1.5 $\mu J/cm^2$)] were measured. When the value of Vi is high, a concentration of the toner is low and a copied image is worn.

Adhesion

An adhesion of the obtained photosensitive member was evaluated according to JIS K5400.

The photosensitive member was subjected to the evaluation test after it was left under the hot and humid circumstances (temperature: 30° C.; humidity: 85%) for 1 day. The adhesion of the photosensitive layer in each of the aforementioned photosensitive members was measured by examining a peeling state of the surface protective layer in each of the photosensitive members at the time when an adhesive tape, which was sticked over the checkers formed by scratching the surface of each photosensitive member with a cutter knife at a pitch of 1 mm within one centimeter square in its early stage after it was made, was instantaneously peeled from said surface. The standards for evaluating the adhesion of the surface protective layer are as follows:

10 . . . Each scratch is a fine line whose both sides are smooth, and no peeling appears at an intersecting point of the scratches and each square.

8 . . . Although a slight peeling is observed at the intersecting points of the scratches, no peeling appears at each square, and an area of defective parts does not exceed 5% of the total area of the squares.

6 . . . Peeling is observed at the both sides and the intersecting points of the scratches, and the area of the defective parts is 5–15% of the total area of the squares.

4 . . . A width of the peeling at the scratches is broad and the area of the defective parts is 15–35% of the total area of the squares.

2 . . . The width of the peeling at the scratches is broader than that of the standard "4" and the area of the defective parts is 35–65% of the total area of the squares.

0 . . . The area of the total defective parts due to the peeling is 65% and more of the total area of the squares.

Cracks

An existence of cracks in a surface of the photosensitive member obtained was evaluated by a visual observation. The standards for evaluating the crack are as follows:

"○": An occurrence of the cracks was not observed.

"X": An occurrence of the cracks was observed.

Image Qualities

Qualities of the copied images which were obtained at an initial stage or after 10000 sheets of papers were successively copied were evaluated.

The obtained photosensitive members were installed into the commercially available electrophotographic copying machine (Di620 manufactured by Minolta Co., Ltd.), and the qualities of the copied images which were obtained at the initial stage or after 10000 sheets of papers were successively copied by means of said machine were evaluated according to the following standard under the circumstance of 10° C./15%, 23° C./45% or 30° C./85%.

"○": A fogging, an image shading and an image flowing were not observed.

"Fogging": A fogging was occurred.

"Image shading": An image shading was occurred.

"Image flowing": An image flowing was occurred.

The results obtained were summarized in Table 1.

TABLE 1

| | | | | | | Image qualities | | | | | |
|---|---|---|---|---|---|---|---|---|---|---|---|
| | | | | | | 10° C./15% | | 23° C./45% | | 30° C./85% | |
| | VO | E1/2 | Vi | Adhesion | An existence of cracks | Initial stage | After $10^4$ sheets were copied | Initial stage | After $10^4$ sheets were copied | Initial stage | After $10^4$ sheets were copied |
| Ex. 1 | −605 | 0.48 | 182 | 8 | ○ | ○ | ○ | ○ | ○ | ○ | ○ |
| Ex. 2 | −610 | 0.46 | 175 | 8 | ○ | ○ | ○ | ○ | ○ | ○ | ○ |
| Ex. 3 | −600 | 0.46 | 170 | 8 | ○ | ○ | ○ | ○ | ○ | ○ | ○ |
| Com. Ex. 1 | −615 | 0.52 | 230 | 0 | X(2) | — | — | — | — | — | — |
| Com. Ex. 2(1) | −605 | 0.49 | 192 | 2 | X(3) | — | — | — | — | — | — |
| Com. Ex. 3(1) | −600 | 0.52 | 240 | 8 | ○ | Fogging | — | ○ | ○ | Image shading | Image flowing |

(1)The image qualities were not observed because of poor adhesion.
(2)Cracks were occurred on the whole surface of the photosensitive member.
(3)Cracks were occurred on a partial surface of the photosensitive member.

According to the photosensitive member for electrophotography of the present invention in which the surface protective layer consists of at least a fluorine-containing polysiloxane, an ultraviolet absorber and an electroconductive fine particles, excellent effects, such as (i) an increase of an adhesion of the surface protective layer to the photosensitive layer, (ii) increases of image qualities and electrostatic properties at the time of plate wearing under all-circumstance, and (iii) no occurrence of cracks and the like can be obtained.

What is claimed is:

1. A photosensitive member for electrophotography comprising:

an electroconductive support, a photosensitive layer, and a surface protective layer comprising a binder resin consisting of a fluorine-containing polysiloxane, an ultraviolet absorber and electroconductive fine particles.

2. The photosensitive member for electrophotography of claim 1, wherein the surface protective layer is a layer prepared by a process comprising applying onto the photosensitive layer a coating solution containing a reaction product of an organosilane with a fluorine-containing silane coupling agent, the ultraviolet absorber and the electroconductive fine particles, and curing said reaction product.

3. The photosensitive member for electrophotography of claim 1, wherein the fluorine-containing polysiloxane is a product prepared by introducing a fluorine atom into polysiloxane.

4. The photosensitive member for electrophotography of claim 1, wherein the ultraviolet absorber is at least one of the compounds selected from the group consisting of benzophenone compounds, benzotriazole compounds, benzoate compounds and salicylate compounds.

5. The photosensitive member for electrophotography of claim 1, wherein the electroconductive fine particles have a mean primary particle size of 0.01–1 $\mu$m.

6. The photosensitive member for electrophotography of claim 1, wherein the surface protective layer has a thickness of 0.03–5 $\mu$m.

7. The photosensitive member for electrophotography of claim 1, wherein the photosensitive layer is a monolayered photosensitive layer comprising a charge generating material and a charge transporting material.

8. The photosensitive member for electrophotography of claim 1, wherein the photosensitive layer is a laminated photosensitive layer comprising a charge generating layer and a charge transporting layer.

9. The photosensitive member for electrophotography of claim 1, wherein an undercoat layer is between the electroconductive support and the photosensitive layer.

10. The photosensitive member for electrophotography of claim 1, wherein the electroconductive support has an anodized layer on its surface.

11. A method of producing a photosensitive member for electrophotography, which comprises forming a photosensitive layer on an electroconductive support, and forming a surface protective layer on said photosensitive layer by applying a coating solution comprising a reaction product of an organosilane with fluorine-containing silane coupling agent, an ultraviolet absorber and electroconductive fine particles, and curing said reaction product in the applied solution, said protective layer comprising fluorine-containing polysiloxane, the ultraviolet absorber and the electroconductive fine particles.

12. The method of claim 11, wherein the organosilane is a compound represented by the following general formula (I):

$$(R^1)_n Si(OR^2)_{4-n} \quad (1)$$

wherein $R^1$ is an organic group having $C_1$–$C_8$, $R^2$ is a hydrogen atom, an alkyl group having $C_1$–$C_5$ or an acyl group having $C_1$–$C_4$, and n is an integer of 0–3.

13. The method of claim 11, wherein the fluorine-containing silane coupling agent is a compound represented by the following general formula (II):

$$CF_3(CF_2)_m(CH_2)_p\underset{\underset{R^4_{3-q}}{|}}{Si}(OR^3)_q \quad (II)$$

wherein each of $R^3$ and $R^4$ is independently a hydrogen atom or an alkyl group having $C_1$–$C_3$, m is integer of 1–7, p is an integer of 1 or 2, and q is an integer of 2 or 3.

14. A photosensitive member for electrophotography comprising:

an electroconductive support, a photosensitive layer, and a surface protective layer comprising a fluorine-containing polysiloxane, an ultraviolet absorber and electroconductive fine particles which are those subjected to a surface treatment with a treating agent represented by the following general formula (III):

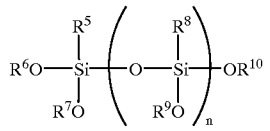

(III)

wherein each of $R^5$, $R^6$, $R^7$, $R^8$, $R^9$ and $R^{10}$ is independently a methyl group or an ethyl group, and n is an integer of 1 or more.

15. The photosensitive member of electrophotography of claim 14, wherein the fluorine-containing polysiloxane is a product prepared from an organosilane and a fluorine-containing silane coupling agent.

16. The photosensitive member for electrophotography of claim 12, wherein the surface protective layer is a layer prepared by a process comprising applying onto the photosensitive layer a coating solution containing a reaction product of an organosilane with a fluorine-containing silane coupling agent, the ultraviolet absorber and the electroconductive fine particles, and curing said reaction product.

17. The photosensitive member for electrophotography of claim 14, wherein the fluorine-containing polysiloxane is a product prepared by introducing fluorine atom into polysiloxane.

18. The photosensitive member for electrophotography of claim 14, wherein the surface protective layer has a thickness of 0.03–5 μm, and the electroconductive fine particles have a mean primary particle size of 0.01–1 μm.

* * * * *